United States Patent [19]

Roman

[11] 3,948,376

[45] Apr. 6, 1976

[54] COIN-COLLECTING RECEPTACLE FOR USE IN COIN-OPERATED DEVICES

[75] Inventor: Tadeo Roman, Sao Paulo, Brazil

[73] Assignee: Diverama Diversoes Automati Cas Industria E Comercio Ltda°, Brazil

[22] Filed: Dec. 27, 1973

[21] Appl. No.: 428,907

[30] Foreign Application Priority Data

May 10, 1973 Brazil ..... 62373840

[52] U.S. Cl. ..... 194/1 B; 232/15

[51] Int. Cl.[2] ..... G07F 9/06

[58] Field of Search..... 194/1 A, 1 B, 10; 232/15, 232/16

[56] References Cited

UNITED STATES PATENTS

| | | | |
|---|---|---|---|
| 3,083,896 | 4/1963 | Cairelli et al. | 232/15 |
| 3,154,246 | 10/1964 | Christensen | 194/1 B |
| 3,235,875 | 2/1966 | Mails | 194/1 B |
| 3,292,849 | 12/1966 | Ewing | 232/15 X |
| 3,527,176 | 9/1970 | Losapio | 232/15 X |
| 3,527,330 | 9/1970 | Schmitt et al. | 194/10 |

*Primary Examiner*—Robert B. Reeves
*Assistant Examiner*—Francis J. Bartuska
*Attorney, Agent, or Firm*—Michael J. Striker

[57] ABSTRACT

A coin-operated device is provided with a container defining a compartment for receiving a receptacle. The receptacle has a lock arresting the receptacle in the container upon insertion of the former into the latter, and a lid which can be locked in the closed position thereof. Coins inserted into the receptacle through a slot pass into a coin-distinguishing mechanism located in the interior of the receptacle, and the signal generated by the coin-distinguishing mechanism is conducted to terminals of the circuitry of the device to start the operation thereof.

6 Claims, 4 Drawing Figures

COIN-COLLECTING RECEPTACLE FOR USE IN COIN-OPERATED DEVICES

BACKGROUND OF THE INVENTION

The present invention relates to coin-operated devices in general, and more particularly to a coin-collecting receptacle for use in such coin-operated devices.

Coin-operated devices, such as vending machines, coin-operated washers and driers, coin telephones and similar devices have found increasing utilization in various fields of human endeavor during the years past. Even though these devices operate according to different principles, they have on thing in common: namely, the coin-operated control apparatus which includes a coin-distinguishing mechanism capable of distinguishing between coins of proper value and coins of improper value or slugs, of rejecting the latter, and of activating the device proper upon insertion of the proper amount of money in coins or tokens, and a coin-collecting receptacle. The construction and operation of the coin-operated devices is so well known and unimportant for understanding the invention that elaboration thereon seems superfluous. However, it is pointed out that usually such devices comprise an electric switch which forms a part of the control apparatus and which is adapted to close the electric circuit of the device itself, so as to put the latter into operation.

There are already known various control apparatuses of the above-mentioned type, which have various degrees of sophistication. In one of the simpler apparatuses of the above type, the coin-distinguishing mechanism is located in the interior of the device, and a separate coin-collecting receptacle is provided which collects the coins which have been accepted by the coin-distinguishing mechanism. The coin-distinguishing mechanism is either attached to a locked door which also gives access to the other parts of the device for replenishing or repair purposes, or is located in a separate compartment of the device which is accessible independently of the access to the remaining parts of the device. In both instances, the receptacle is located in the immediate vicinity of the coin-distinguishing mechanism, and the contents thereof are easily accessible to the person having access to the compartment and/or interior of the device. Usually, such a collecting receptacle has an open top, and the contents thereof is emptied for a different receptacle when some amount of coins has accumulated in the first-mentioned receptacle, the latter being replaced into the device or the compartment thereof while the contents are being delivered in the owner or lessor of the device. It is evident that this is a very sensitive operation which must be done by the owner or lessor himself or his trusted employee, and that this arrangement gives an opportunity for misappropriation of the collected coins by the employee himself or by a third person robbing the latter.

To avoid the former possibility, some of the devices are provided with a separate counting mechanism which counts the amount of money which was passed through the coin-distinguishing mechanism into the receptacle, thus affording an independent device for double-checking. However, even this arrangement does not avoid the other possibility, that is the opportunity given to a potential thief by storing the money collected from one or several devices in the second-mentioned receptacle. Even if this other receptacle is locked, the employee collecting the contents of the various first receptacle has to have a key affording him access to the interior of the second receptacle, and he might lose this key or be forced to relinquish it.

Moreover, the devices of the above kind are susceptible to tampering, mainly due to the fact that the coin-distinguishing mechanism and the switch thereof are easily accessible, for instance while the device is being repaired or while some pairs thereof have been removed for repair. This, of course, is a considerable disadvantage resulting in economic losses to the owner or lessor of such a device.

SUMMARY OF THE INVENTION

Accordingly, it is an object of the present invention to provide a coin-collecting receptacle to be used in coin-operated devices which is not possessed of the disadvantages of the prior art.

More particularly, it is an object of the present invention to provide a locked receptacle for use in such devices.

Still more particularly, it is an object of the present invention to provide an interchangeable receptacle to be used in various devices of the above-mentioned type.

It is still another object of the invention to provide a receptacle for collecting coins which is accessible only at a location remote from the device in which it has been used.

It is yet another object of the invention to provide a receptacle of the type which incorporates the coin-detecting mechanism.

It is a concomitant object of the present invention to provide a receptacle which incorporates the control apparatus for activating the device and which is easily connectable to the device.

In pursuance of these objects and others which will become apparent hereinafter, one feature of the present invention resides in provision of a container which is fixedly attached to the coin-operated device and defines a compartment therein, and of an interchangeable or standardized receptacle which is insertable into the above-mentioned container and rigidly but detachably connected to the container. In the currently preferred embodiment of the invention, the receptacle is a locked box which is inserted into the container and secured therein by means of an additional lock engaging one or more slots in the container.

According to a different feature of the invention, the coin-distinguishing mechanism and the switch forming parts of the control apparatus are accommodated in the interior of the receptacle, and the switch is connected by means of electric lines to the electric circuitry of the device. Preferably, there are provided two contact plates on the rear wall of the receptacle, which contact plates contact the terminals of the electric circuitry of the device when the receptacle is fully inserted into the container and locked therein.

The above-described arrangement is advantageous in various respects. First of all, the receptacle is very compact, including the entire control apparatus, so that if the control apparatus becomes jammed or breaks down, it may be removed from thee device together with the receptacle for repair without any need to interrupt the operation of the device for extended periods of time while the apparatus is being repaired in situ. Namely, the receptacle with the malfunctioning control apparatus is simply removed from the container and replaced by a functioning receptacle. Secondly, since the personnel replacing the receptacles in various devices does not have access to the contents of the receptacle which can only be opened by a different key, there is no danger of pecuniary damage to the owner or lessor of the device inflicted upon the latter by his collecting personnel and there is no need to provide relatively expensive counting mechanisms in order to double-check the honesty of the personnel. Finally, since the personnel does not have the key to the receptacle, the danger of robbery is substantially reduced.

The novel features which are considered as characteristic for the invention are set forth in particular in the appended claims. The invention itself, however, both as to its construction and its method of operation, together with additional objects and advantages thereof, will be best understood from the following description or specific embodiments when read in connection with the accompanying drawing.

DESCRIPTION OF THE PREFERRED EMBODIMENTS

Figures 1, 2:
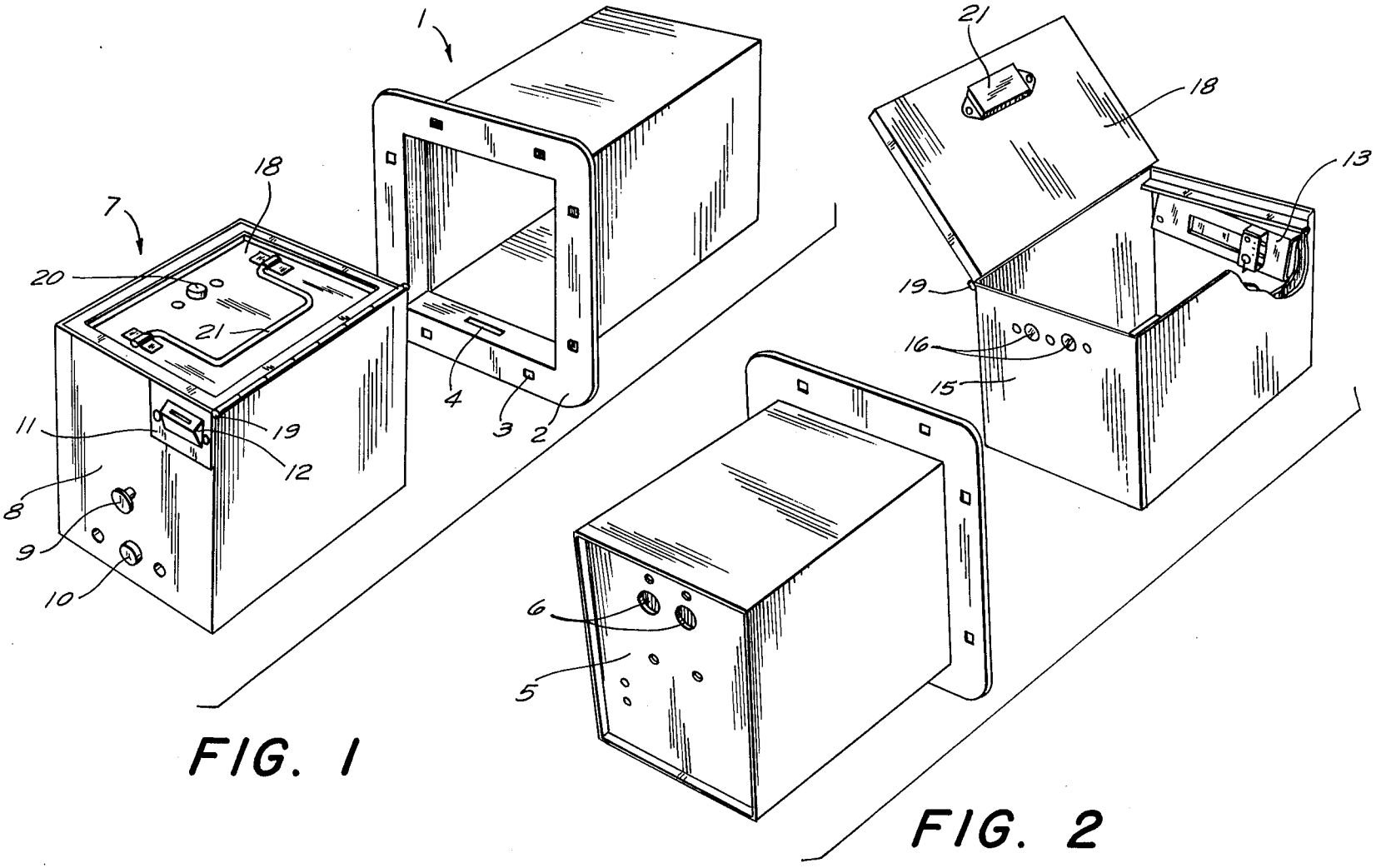
FIG. 1 is an exploded perspective front view of the container and the receptacle according to the invention.
FIG. 2 is an exploded perspective rear view of the container and the receptacle.
Figure 4:
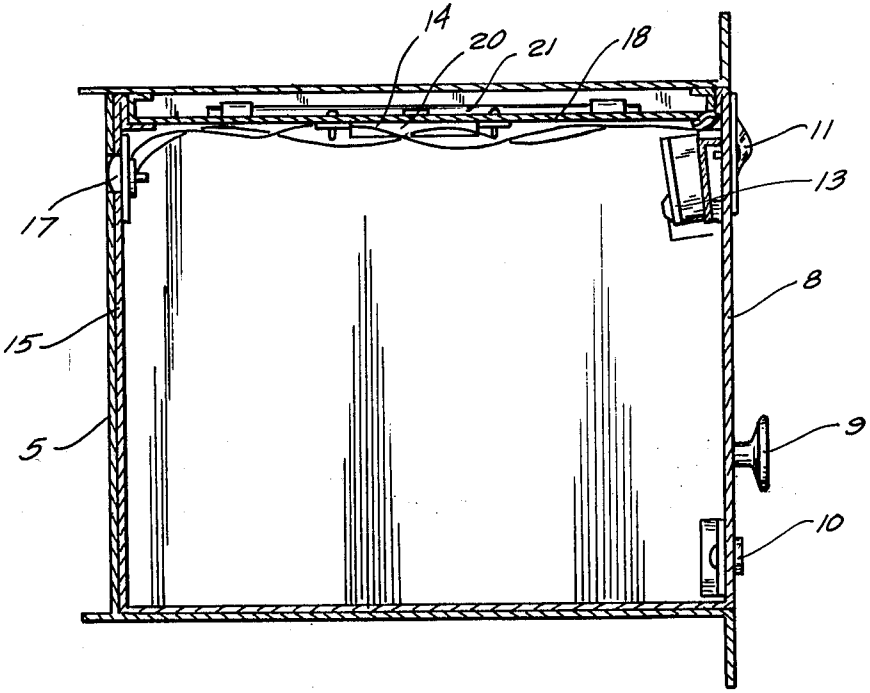
FIG. 4 is a cross-sectional view of the container and the receptacle taken on line A—A of FIG. 3.

Referring now to the drawings, and firstly to the FIG. 1 thereof, it may be seen that the coin-operated device, such as a vending machine, or a similar device, is provided with a container 1 which has a flange 2 which is provided with a plurality of apertures 3 through which, when the device is assembled, a plurality of attachment elements, such as rivets or bolts, extends. Since the location and the particular mode of attachment of the container to the device proper is unimportant for understanding the invention, only the container 1 is being illustrated. The container 1 is further provided with at least one recess 4 the purpose of which will be discussed later on, and further comprises a rear wall 5 which is provided with at least one, but preferably two holes 6.

A receptacle 7 embodying the invention is insertable into the container 1 and has a front wall 8 which is exposed when the receptacle 7 is inserted into the container 1. A knob 9 is attached to the front wall 8 of the receptacle 7 and serves the purpose of facilitating removal of the receptacle 7 from the container 1. A lock 10 is also attached in any known manner to the front wall 8 and is so situated that when the receptacle 7 is inserted into the container 1, the lock 10 is aligned with the recess 4 so that the latching element of the lock 10 engages the recess 4 either automatically upon insertion of the receptacle 7 into the container 1, or after the lock 10 is locked by an appropriate key. Of course, if more than one recess 4 is provided in the container 1, then more than one latching element may be provided, each engaging a respective one of the recesses, and the latching elements may be actuated either individually or simultaneously.

Figure 3:
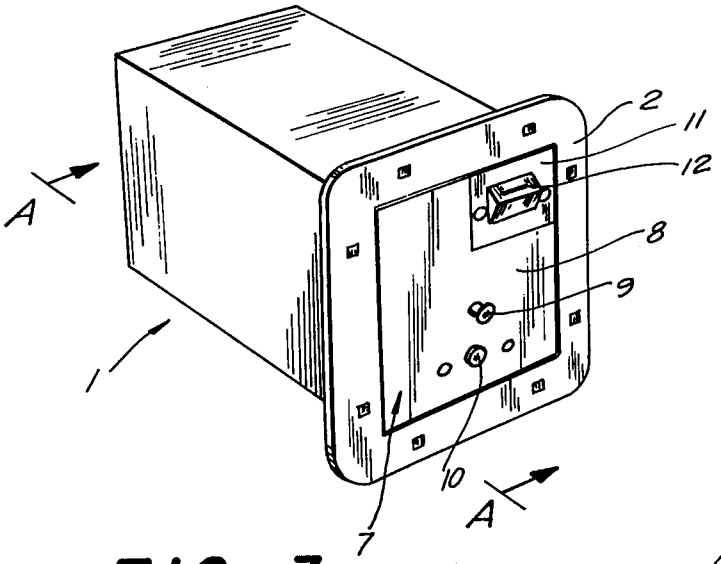
FIG. 3 is a perspective front view of the container with the receptacle accommodated therein.

A coin-accepting element 11 is affixed to the front wall 8 and is provided with a slot establishing communication between the exterior and the interior of the receptacle 7. The dimensions of the slot 12 are so selected as to permit insertion of coins of the proper value. It is to be understood that the expression coins as used in this specification and in the appended claims is meant to include both mometary and non-monetary coins, such as tokens. A coin-distinguishing mechanism 13 of conventional design is attached to the front wall 8 of the receptacle, and is aligned with the slot 12, so that when a coin is inserted into the slot 12, it passes into the coin-distinguishing mechanism 13 which may be of a simple type accepting only one kind of coins, or more complex accepting coins of various denominations. If so desired, the front wall 8 may also be provided with a coin-return element (not shown) serving the purpose of returning rejected coins or returning change if the value of the coin inserted into the slot 12 exceeds the value of goods or services sold. In the currently preferred embodiment, the coin-distinguishing mechanism 13 is of an electric type, generating electric signal or closing an electric switch upon acceptance of the coin. The electric signal generated in, or the electric current passing through the switch of, the coin-distinguishing mechanism passes through wires 13 to the rear of the receptacle 7. A rear wall 15 of the receptacle 7 is provided with at least one opening 16 which in the inserted position of the receptacle 7 in the container 1 is aligned with the hole(s) 6 of the rear wall 5 of the container 1. Contact elements 17 (FIG. 3) are attached to the rear wall 15 of the receptacle 7 and project into the openings 16 in such a manner as to contact electric terminals (not shown) of the circuitry of the coin-operated device. As a result of this arrangement, the electric signal generated in, or the electric current passing through, the coin-distinguishing mechanism 13 is delivered into the circuitry of the device, thus starting its operation.

The receptacle 13 further comprises a lid 18, which in the currently preferred embodiment of the invention is attached to one of the walls of the receptacle by a hinge 19 so as to be movable between an open and a closed position thereof. A lock 20 is attached to the lid 18 and is adapted to engage in a known manner a recess (not shown) in one of the walls of the receptacle 7 so as to prevent unauthorized opening thereof. It is evident that the lock 20 may actuate several latching elements for added security.

The lid 18 may also be provided with a handle 21 of conventional design which facilitates transportation of the receptacle 7 to the destination at which the receptacle 7 is opened to remove its contents.

It may be seen that the receptacle 7 may be interchangeably used in any of a plurality of coin-operated devices provided with the described container 1. The receptacle 7 itself, and the utilization thereof are very simple, resulting in time savings and only a minimum period of time during which the operation of the device is discontinued while the receptacle 7 is being replaced by a different one. Once the receptacle 7 is inserted into the container 1 and locked in, the device is ready for use, regardless whether the previous receptacle has been removed for coin-collection purposes or for repair of the jammed or malfunctioning coin-distinguishing mechanism 13. The contents of the receptacle 7 is safely retained therein until the receptacle 7 is delivered to the owner or lessor of the device or his agent.

It will be understood that each of the elements described above, or two or more together, may also find a useful application in other types of constructions differing from the type described above.

While the invention has been illustrated and described as embodied in a coin-operated device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a coin-operated device, a combination comprising a container permanently attached to the device and having an open end facing the exterior of the device; a receptacle interchangeably inserted into said container through said open end and having walls a front one of which is accessible from the exterior of the device when the receptacle is fully inserted into said container, and a lid mounted on one of said walls for pivoting between an open position and a closed position, said walls and said lid of said receptacle when in its closed position completely enclosing an interior of said receptacle; means for preventing unauthorized access to said interior of said receptacle and including first means for locking said receptacle in said container and second means for locking said lid of said receptacle in said closing position; means for conducting coins from the exterior of the device into said interior of said receptacle and including a coin-accepting element at said front wall of said receptacle and provided with a slot; and means for commencing operation of the device upon acceptance of coins of proper value and including coin-distinguishing means in said interior of said receptacle and attached to said front wall of said receptacle in alignment with said slot.

2. A combination as defined in claim 1, and further comprising a knob attached to said front wall and operative for removal of the receptacle from the container.

3. A combination as defined in claim 1, and further comprising a hinge connecting said lid to said one wall.

4. A combination as defined in claim 3, wherein an additional wall of said receptacle is provided with an additional recess; and wherein said second means for locking includes an additional latching element adapted to engage said additional recess when said lid is in said closed position thereof.

5. A combination as defined in claim 1, wherein said receptacle has a rear wall provided with at least one opening; said operation-commencing means further comprising conductor means for conducting a signal generated in said coin-distinguishing mechanism upon acceptance of a coin to the rear of said receptacle, and contact plates connected to said conductor means and attached to said rear wall and adapted to contact terminals of the electric circuitry of said device whereby to selectively put the latter into operation.

6. A combination as defined in claim 1, wherein said first locking means includes at least one recess in said container adjacent said open end thereof, and a lock attached to said front wall and having at least one latching element aligned with and engaging said recess when said receptacle is fully inserted into said container.

* * * * *

UNITED STATES PATENT AND TRADEMARK OFFICE

CERTIFICATE OF CORRECTION

PATENT NO. : 3,948,376

DATED : April 6, 1976

INVENTOR(S) : Tadeo Roman

It is certified that error appears in the above-identified patent and that said Letters Patent are hereby corrected as shown below:

[30] The serial number of the Brazilian application should read: 03397

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*